US006681540B2

(12) United States Patent
Richardson

(10) Patent No.: US 6,681,540 B2
(45) Date of Patent: Jan. 27, 2004

(54) DEVICE FOR FORMING AN EXPANSION JOINT IN A FLOOR SURFACE

(76) Inventor: E. Wayne Richardson, 3665 Pine St., Doraville, GA (US) 30340

( * ) Notice: Subject to any disclaimer, the term of this patent is extended or adjusted under 35 U.S.C. 154(b) by 34 days.

(21) Appl. No.: 10/083,870

(22) Filed: Feb. 27, 2002

(65) Prior Publication Data

US 2003/0159388 A1 Aug. 28, 2003

(51) Int. Cl.[7] ..... F04B 5/00

(52) U.S. Cl. ..... 52/376.04; 52/393; 52/396.04; 52/396.08; 52/396.1; 52/318; 52/742.1; 52/742.16; 52/573.1; 404/47; 404/64; 404/65; 404/74

(58) Field of Search ..... 52/393, 396.04, 52/396.08, 396.1, 318, 742.1, 742.16, 573.1; 404/47, 64, 65, 74

(56) References Cited

U.S. PATENT DOCUMENTS 307,586 A * 11/1884 Phillips ..... 52/396.08
1,890,954 A * 12/1932 Snyder ..... 52/396.1
1,891,530 A * 12/1932 Galassi ..... 404/47
3,136,022 A * 6/1964 Dohren ..... 404/64 X
3,179,026 A * 4/1965 Crone ..... 404/47
3,330,187 A * 7/1967 Kohler et al. ..... 404/65
3,388,643 A * 6/1968 Webb ..... 404/65
D236,718 S * 9/1975 Patterson ..... D25/121
3,953,661 A * 4/1976 Gulley ..... 52/396.02
5,092,091 A * 3/1992 Hull et al. ..... 52/396.02
5,333,432 A * 8/1994 Schluter ..... 52/396.1
6,272,806 B1 * 8/2001 Face, III ..... 52/396.04

* cited by examiner

*Primary Examiner*—Carl D. Friedman
*Assistant Examiner*—Steve Varner
(74) *Attorney, Agent, or Firm*—Smith, Gambrell & Russell, LLP

(57) ABSTRACT

Disclosed is a unitary resilient insert member for filing an expansion joint gap formed between adjacent concrete slabs, floor tiles, or the like wherein the insert member consisting essentially of a preassembled wedge shape form. Also disclosed is a method for sealing the gap located between adjacent flooring or structural members by filling the said gap with a sealing material insert.

19 Claims, 1 Drawing Sheet

DEVICE FOR FORMING AN EXPANSION JOINT IN A FLOOR SURFACE

BACKGROUND OF THE INVENTION

The present invention relates to a device for forming expansion joints in floor surfaces such as a concrete or like slab, including slabs covered with ceramic or the like tiles, in which the device is a wedge shaped insert.

Forming an expansion joint between two floor sections which are covered with ceramic tiles is known. U.S. Pat. No. 5,333,432 discloses a device for forming an expansion joint in a floor covered with ceramic tiles which includes a first plastic angle floor section to be secured onto the floor and formed by a fastening leg and terminating leg, and a second plastic wall section shaped like a strip with interlocking elements on its outer side. Both sections are connected by an upper soft plastic bridge simultaneously covering the respective section segments from the top. Also known is forming an expansion joint by two angle sections made of plastic material having terminating legs which are arranged parallel with one another with a spacing therebetween, the angle sections connected both at the top and at the bottom by elastic soft plastic bridges, forming a hollow space.

Box-shaped plastic sections are also known for forming stress-relieving joints in floors and walls in which the section has recoiling side walls made of hard plastic material. These side walls are fitted with outer interlocking elements and are connected by elastic soft plastic bridges.

When a concrete flooring surface is installed, a gap is ordinarily left between adjacent slabs of concrete. These gaps allow the concrete slabs room to move due to settling of a structure, and to expand and contract due to environmental temperature changes.

A typical concrete flooring surface consists of concrete slabs of large dimensions. Each slab is separated from adjacent slabs by a gap sometimes as much as ½ inch. To provide a finished flooring surface, a flooring material such as tile is applied to the surface of the concrete slabs with the edges of the tiles even with the edges of the concrete slabs at each edge of the expansion joint. When adjacent concrete slabs contract, they separate, and they will carry the tile adhered thereto with them. If tile were laid over the gap, the tile would crack. Accordingly, upon contraction the gap between the concrete slabs will increase, thus causing a gap to appear between adjacent tiles applied to respective adjacent slabs of concrete. When adjacent concrete slabs expand and move closer together, the tiles adhered to adjacent concrete slabs may chip, crack, break or come unadhered from the concrete slab, as the tiles from adjacent slabs push against each other.

In view of the foregoing problems, there is a need for a device which can fill the gap between adjacent concrete slabs and adjacent tiles and prevent exposure of the gap when adjacent concrete slabs move further apart, and for maintaining a generally continuous flooring surface when adjacent concrete slabs move closer.

SUMMARY OF THE INVENTION

It is an object of the present invention to provide a device for forming an expansion joint in the area connecting joints in concrete slabs and in a floor covered with ceramic or the like tiles.

This object is achieved according to the present invention by providing a device for forming an expansion joint between the slabs or the tiles of a floor comprising an elastomeric wedge such as a V-shape having a top flat surface and two angled side surfaces that connect or intersect. The lower portion of the V-wedge is inserted between the slabs or tiles until the flat top is level with the surface of the slab or tiles, or slightly protruding above the surface of the slab or tiles and then the protruding portion cut off or otherwise removed.

Without requiring additional fastening elements, the device according to the invention can be secured within the joint formed between the slab or tiles of the floor.

Movements occurring, for example, due to thermal stresses between the slabs or tiles of the floor, are absorbed by the device according to the invention. Even if there should be much greater movement between the slab or floor tiles due to use, adequate clearance will still be available with the device. The present structure maintains intact, absorbing stresses which permits movement while keeping the floor tiles stationary.

It is an object of the present invention to provide an expansion joint insert member for providing a continuous flooring surface between adjacent slabs or tiles.

It is another object of the present invention to provide an expansion joint insert member which is easily installed in the gap between adjacent slabs or tiles.

It is another object of the present invention to provide an expansion joint insert member which provides a seal between tiles applied to adjacent concrete slabs or other flooring material.

It is another object of the present invention to provide an expansion joint insert member which prevents chipping and cracking of tiles applied to the surface of adjacent flooring material.

It is still another object of the present invention to provide an expansion joint insert member which remains in contact with the tiles when the flooring materials move further from each other, as during settling or thermal contraction of the tiles and/or flooring materials.

It is yet another object of the present invention to provide an expansion joint insert member which prevent tiles from becoming damaged, such as by cracking due to a narrowing of the gap between adjacent flooring materials as during thermal expansion.

It is yet another object of the present invention to provide an expansion joint insert member which sufficiently fills the gap between two adjacent slabs or tiles so that the gap remains concealed when the gap widens due to settling or thermal contraction.

A further object of the invention is to provide a joint insert which can be retrofitted into a damaged seam between flooring or tiles to conceal damage done to the tiles.

Other objects and features of the present invention will become apparent from the following detailed description considered in connection with the accompanying drawing which discloses one embodiment of the present invention. It should be understood, however, that the drawing is designed for the purpose of illustration only and not as a definition of the limits of the invention.

DETAILED DESCRIPTION OF THE PREFERRED EMBODIMENT

Figure 1:
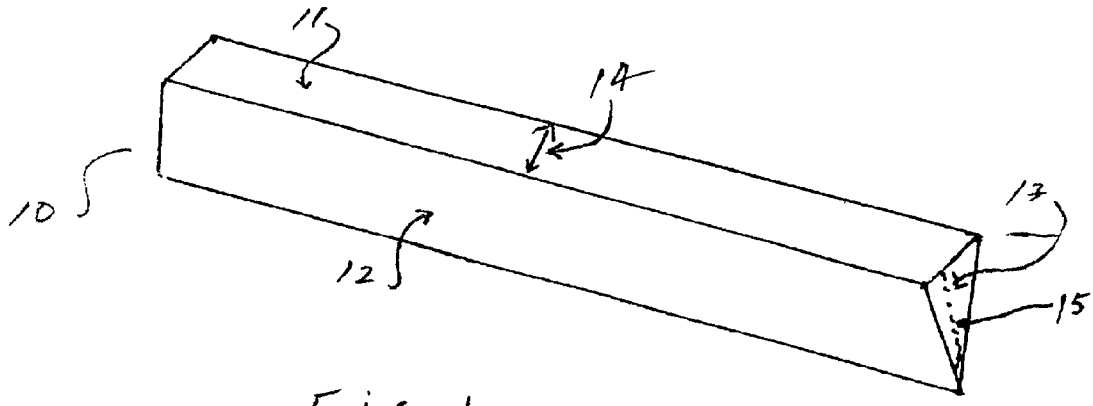
FIG. 1 is a perspective view of one embodiment of the expansion joint device of the present invention.

FIG. 1 depicts one embodiment of the expansion joint device of the present invention, insert member 10. The insert member is in the form of a V or wedge having a top surface 11, side surfaces 12 which intersect or meet and are preferably of the same length thereby forming end portions 13. The insert member or wedge has a width 14 measured across surface 11 and a depth 15 measured from its uppermost portion of top 11 to the point of intersection of sides 12.

The present invention includes a unitary insert member for filing an expansion joint gap formed between adjacent concrete slabs, floor tiles or the like, said insert member consisting essentially of a preassembled wedge shape form. One embodiment of the present invention is a method for sealing the gap located between adjacent flooring or structural members comprising the steps of placing the flooring or structural members adjacent to each other to form a gap therebetween; covering said structural members with a surface layer; providing a gap in the surface layer material; filling said gap with a sealing material insert; and removing any excess insert material above the surface layer. Advantageously the sealing insert is pre-assembled and is inserted into the gap when the surface layer is applied to the structural member or flooring. Alternatively said sealing insert may be inserted into said gap after said surface layer is applied to the structural member or flooring. Advantageously the sealing insert is an elastomer. Preferably the sealing insert is an extruded elastomer and most preferably the sealing insert comprises PVC.

Advantageously the sealing insert is in the form of a wedge and the flooring or structural member is selected from the group consisting of concrete, terrazzo, ceramic, stone, VCT flooring, and combinations thereof. Advantageously the dimensions of the wedge range from a width at the top of the wedge of from about ¼ inch to about 1¼ inches and a depth of from about ⅝ inch to about 2⅜ inches. Preferably the depth of the wedge is graduated in ⅛ inch increments and the width of the wedge is graduated in 1/16 inch increments. Advantageously the sealing insert is about 1/16 inch wider than said gap.

Preferably the present invention includes the step of applying a material selected from an adhesive and a sealant to the interior of the gap before inserting the sealing insert. Advantageously the adhesive or sealant is a foam and most advantageously the adhesive or sealant is polyurethane. Superior results are achieved when the sealing insert is inserted into the gap immediately after the adhesive or sealant is applied. Preferably the adhesive or sealant is allowed to cure or set for at least about 10 minutes after insertion of the sealing insert before further processing. Where appropriate excess sealing insert material is trimmed to the floor or structural member surface level.

As noted above, the present invention provides an expansion joint insert member for filling the gaps or seams between slabs and tiles to make unnoticeable the shifting of the flooring materials. The flooring material and/or tiles may move apart due to the settling of a building or due to thermal contraction. Accordingly, the insert member of the present invention is placed into the gap between the tiles to fill the gap after flooring material and/or tiles have moved apart. In contrast, if the flooring material and/or tiles move closer together due to settling or thermal expansion, the insert member of the present invention will prevent chipping, buckling or otherwise damaging of the tiles, as well as making any changes to the condition of the flooring material unnoticeable.

In some instances gaps may form in flooring material and/or tiles as the flooring material and/or tiles have shifted, which could damage tiles. Gaps could also form in flooring material and/or tiles which has cracked, when the tiles were positioned on the floor. Likewise, flooring material and/or tiles which expand against each other, or parts thereof, on opposite sides of a seam, could expand against or butt against each other. The flooring material and/or tiles which initially butt against each other could contract and form a gap. The foregoing gaps can be cleaned out, and expansion joint inserts, according to the invention, could be retrofitted into the gaps to hide the damage and still enable further movement between contiguous flooring material and/or tiles.

It should be appreciated that the insert member of the present invention can be made of various colors in order to match or harmonize with existing colored flooring materials and/or tile.

The foregoing description is a specific embodiment of the present invention. It should be appreciated that the embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

What is claimed is:

1. A method for sealing a gap located between adjacent flooring members, between adjacent structural members, and between flooring members and adjacent structural members comprising the steps of:

a. placing the flooring members and/or structural members adjacent to each other to form a first gap between said flooring members, or between said structural members or between said flooring members and said structural members;

b. covering said flooring members and/or structural members with a surface layer material;

c. providing a second gap in the surface layer material;

d. filling said first and second gaps with a sealing material insert; and e. removing any excess insert material above the surface layer.

2. The method according to claim 1, wherein said sealing insert is pre-assembled and is inserted into the gap when the surface layer is applied to the structural member and/or flooring member.

3. The method according to claim 1, wherein said sealing insert is inserted into said gap after said surface layer is applied to the structural member and/or flooring member.

4. The method of claim 3 including the step of applying a material selected from an adhesive and a sealant to the interior of the gap before inserting the sealing insert.

5. The method of claim 4 wherein the adhesive or sealant is a foam.

6. The method of claim 4 wherein the adhesive or sealant is polyurethane.

7. The method of claim 4 wherein the sealing insert is inserted into the gap immediately after the adhesive or sealant is applied.

8. The method of claim 7 wherein the adhesive or sealant is allowed to cure or set for at least about 10 minutes after insertion of the sealing insert before further processing.

9. The method of claim 8 including the step of trimming excess sealing insert material to the floor member or structural member surface level.

10. The insert method of claim 1, wherein the sealing insert is an elastomer.

11. The insert method of claim 1, wherein the sealing insert is an extruded elastomer.

12. The insert method of claim 11, wherein the sealing insert comprises PVC.

13. The insert method of claim 1, wherein the flooring member and structural member are selected from the group consisting of concrete, terrazzo, ceramic, stone, VCT flooring and combinations thereof.

14. The insert method of claim 13, wherein the flooring member and structural member are a concrete slab.

15. The insert method of claim 1, wherein the dimensions of the sealing insert range from a width at the top of the insert of from about ¼ inch to about 1¼ inches and a depth of from about ⅝ inch to about 2⅜ inches.

16. The method of claim 15, wherein the depth of the sealing insert is graduated in ⅛ inch increments.

17. The method of claim 15, wherein the width of the sealing insert is graduated in 1/16 inch increments.

18. The method of claim 1, wherein the sealing insert is about 1/16 inch wider than said second gap.

19. The method of claim 1 wherein said sealing insert is manufactured of a resilient material.

* * * * *